US009425543B2

(12) United States Patent
Sprenger et al.

(10) Patent No.: US 9,425,543 B2
(45) Date of Patent: Aug. 23, 2016

(54) PROTECTIVE COVER FOR A CONNECTOR

(71) Applicant: INTEL CORPORATION, Santa Clara, CA (US)

(72) Inventors: Mark Sprenger, Folsom, CA (US); Russell Aoki, Tacoma, WA (US); David Pidwerbecki, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 35 days.

(21) Appl. No.: 14/498,990

(22) Filed: Sep. 26, 2014

(65) Prior Publication Data

US 2016/0093979 A1 Mar. 31, 2016

(51) Int. Cl.
*H01R 13/52* (2006.01)

(52) U.S. Cl.
CPC ..... *H01R 13/5213* (2013.01)

(58) Field of Classification Search
CPC . H01R 13/6205; H01R 13/629; H01R 13/703
See application file for complete search history.

(56) References Cited

U.S. PATENT DOCUMENTS 5,478,250 A * 12/1995 Hoffman ..... B60L 11/1818 220/3.8
5,791,930 A * 8/1998 Tabata ..... H01R 13/641 439/345
6,497,516 B1 * 12/2002 Toyooka ..... G02B 6/3882 385/78
7,686,629 B1 * 3/2010 Yu ..... H01R 13/447 439/136
7,740,494 B2 * 6/2010 Lin ..... H01R 13/4538 439/131
8,102,662 B2 * 1/2012 Hiew ..... G06F 1/1632 361/752
8,292,641 B2 * 10/2012 Kim ..... G06K 19/07732 439/135
8,342,857 B2 * 1/2013 Palli ..... H01R 13/6205 439/38
8,425,243 B2 * 4/2013 Alvarez Rivera .... H01R 13/447 439/142
2004/0229484 A1 * 11/2004 Uchida ..... H01R 13/4538 439/137
2009/0061696 A1 * 3/2009 Lin ..... H01R 13/4538 439/701

OTHER PUBLICATIONS

Browning et al., U.S. Appl. No. 14/229,386, filed Mar. 28, 2014, US Application, Drawings, and Replacement Filing Receipt dated Apr. 22, 2014 attached (62 pages), not yet published.

* cited by examiner

*Primary Examiner* — Truc Nguyen
(74) *Attorney, Agent, or Firm* — International IP Law Group, P.L.L.C.

(57) ABSTRACT

A protective cover for a connector is described herein. In one example, the protective cover can include an angled outer shell to envelop a connector, and a locking mechanism to prevent the angled outer shell from retracting to expose the connector. The protective cover can also include a plunger assembly coupled to a magnet, the magnet to disengage the locking mechanism to expose the connector, and a set of springs to return the angled outer shell to a locked position.

15 Claims, 6 Drawing Sheets

400

500

PROTECTIVE COVER FOR A CONNECTOR

BACKGROUND

1. Field

This disclosure relates generally to protective covers, and more specifically, but not exclusively, to protective covers for connectors.

2. Description

Most computing devices include any number of connectors that can enable a computing device to transmit data through various cables. In some examples, a computing device can include connectors that protrude from a surface of a computing device. For example, a connector for a computing device may protrude from a surface of the computing device to enable the computing device to be coupled or docked to another electronic device or a cable.

BRIEF DESCRIPTION OF THE DRAWINGS

The following detailed description may be better understood by referencing the accompanying drawings, which contain specific examples of numerous features of the disclosed subject matter.

DESCRIPTION OF THE EMBODIMENTS

In some examples, a connector without a protective cover can be damaged during the docking or coupling of an electronic device to the connector. For example, damage to the connector can occur if the connector is exposed to excessive forces as devices or cables are coupled to the connector. In some implementations, a connector can be damaged as an electronic device or cable is connected or coupled to the connector using a tilting, rotating, or twisting technique.

According to embodiments of the subject matter discussed herein, a protective cover can envelop or cover a connector to protect the connector from damage. In some embodiments, the protective cover can envelop and protect any suitable connector such as a universal serial bus 1.0, 2.0, 3.0, or 3.1 connector, a micro universal serial bus connector, a connector that can transmit data using a high-definition multimedia interface or a digital display interface, a small form factor connector, or a connector with any suitable number of pins, among others. For example, the protective cover may cover any suitable connector that mechanically and/or electronically docks a first electronic device to a second electronic device. In some embodiments, the protective cover can retract when force is applied by a cable or electronic device to an outer shell of the protective cover. In some examples, the protective cover can automatically retract to cover a connector when an electronic device or cable is detached or decoupled from the connector.

Reference in the specification to "one embodiment" or "an embodiment" of the disclosed subject matter means that a particular feature, structure, or characteristic described in connection with the embodiment is included in at least one embodiment of the disclosed subject matter. Thus, the phrase "in one embodiment" may appear in various places throughout the specification, but the phrase may not necessarily refer to the same embodiment.

Figure 1:
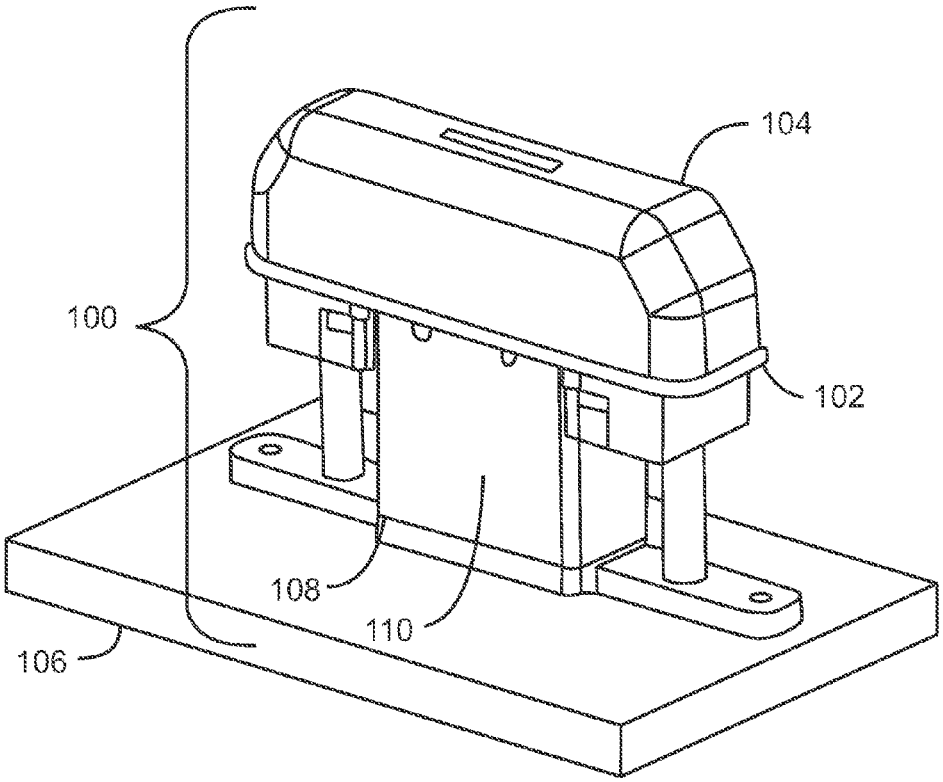
FIG. 1 is a block diagram of an example protective cover in a locked position.

FIG. 1 is an example of a protective cover in a locked position. The protective cover 100 can include a flange 102 and an angled outer shell 104. The flange 102 can provide a surface for which a device can be coupled to the protective cover 100. For example, the flange 102 can provide a surface on the protective cover 100 on which a device coupled to the protective cover 100 can assert a force. In some embodiments, the angled outer shell 104 of the protective cover 100 can allow a device to be coupled with the protective cover 100 from any suitable angle. For example, the device being coupled to the protective cover 100 can engage the protective cover 100 from any suitable angle due to the angled outer shell 104, which can include any number of angled sides. The angled sides may be oriented so that the angled sides are less than perpendicular in relation to a fixed base 108 of the protective cover 100. In some embodiments, the protective cover 100 is attached to a host device 106 through the fixed base 108. The protective cover 100 can envelop or cover a connector 110 that protrudes from a surface of the host device 106. In some embodiments, the connector 110 can include a universal serial bus (also referred to herein as "USB") connector, a micro-USB connector, or a connector with any suitable number of pins, among other suitable connectors. As discussed above, the protective cover 100 can prevent the connector 110 from being damaged. For example, if the connector 110 protrudes from a surface of the host device 106, the protective cover 100 can prevent the connector 110 from being damaged when the connector 110 is engaged or coupled to any suitable cable or computing device.

It is to be understood that the block diagram of FIG. 1 is not intended to indicate that the protective cover 100 is to include all of the components shown in FIG. 1. Rather, the protective cover 100 can include fewer or additional components not illustrated in FIG. 1.

Figure 2:
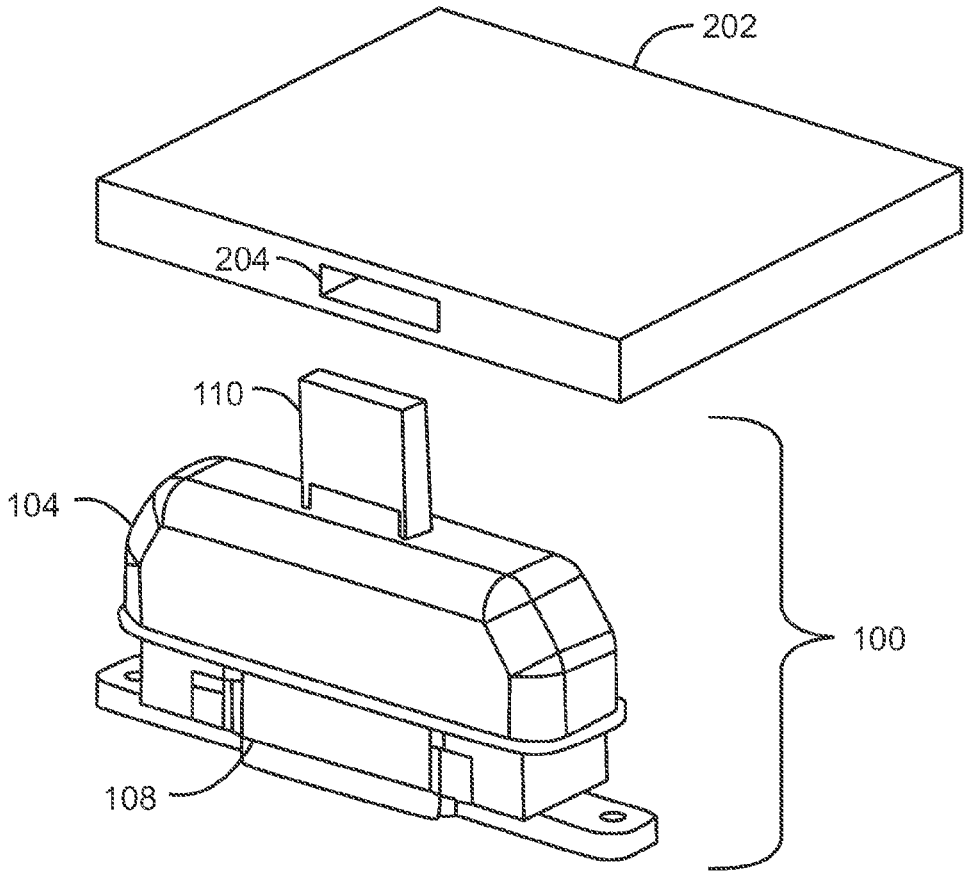
FIG. 2 is a block diagram of an example protective cover retracted exposing a connector to be coupled to a device.

FIG. 2 is a block diagram of an example protective cover retracted exposing a connector. In some embodiments, when an electronic device 202 contacts the protective cover 100 with a force that exceeds a force threshold value, the protective cover 100 can retract to expose a connector 110. In some embodiments, the force threshold value can be configured based on a force to compress springs or other internal features in the protective cover 100. The internal features of the protective cover 100 are discussed in greater detail below in relation to FIG. 3.

In some embodiments, the connector 110 can be coupled to a receptacle 204 in the electronic device 202, which can enable the transmission of data. In some examples, the angled outer shell 104 of the protective shell 100 can enable the receptacle 204 of the electronic device 202 to couple to the connector 110 from a number of angles. For example, the angled outer shell 104 can guide the receptacle 204 to an angle which facilitates coupling of the connector 110 and the receptacle 204.

In some embodiments, the protective cover 100 can flex or move as the electronic device 202 is coupled to the protective cover 100. For example, the protective cover 100 can move relative to the fixed base 108 when the electronic device 202 is within a close proximity to the protective cover 100. In some embodiments, the protective cover 100 can move or flex in response to magnets included in the protective cover 100, which are illustrated below in relation to FIG. 3, engaging magnets in the electronic device 202.

Figure 3:
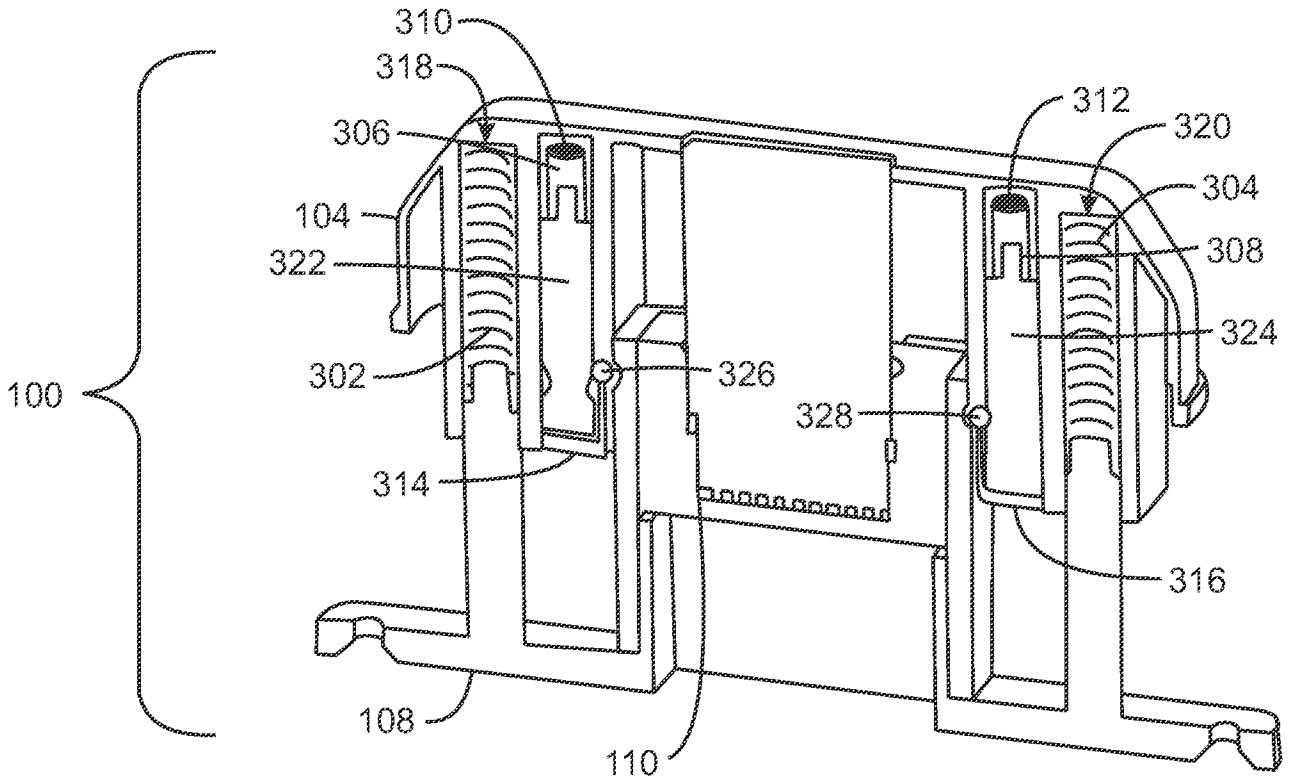
FIG. 3 is a block diagram of internal features of an example protective cover.

FIG. 3 is a block diagram of internal features of an example protective cover. In some embodiments, the protective cover 100 can include a set of springs 302 and 304, plunger assemblies 306 and 308, magnets 310 and 312, and at least one locking mechanism 314 and 316. In some examples, the springs 302 and 304 reside in hollow spring housings 318 and 320 of the protective cover. The springs 302 and 304 can be compressed to expose the connector 110 when an electronic device (not illustrated) applies a force against the angled outer shell 104 of the protective cover 100. The springs 302 and 304 can also be decompressed to return the angled outer shell 104 of the protective cover 100 to a locked position. In some examples, the springs 302 and 304 can be selected based on a predetermined force threshold value that corresponds to a force that is to be applied to the protective cover 100 to expose the connector 110.

In some embodiments, the plunger assemblies 306 and 308 reside in hollow plunger housings 322 and 324. In some examples, the hollow plunger housings can also include the locking mechanisms 314 and 316. Additionally, the magnets 310 and 312 can be attached to the plunger assemblies 306 and 308 so that the magnets 310 and 312 reside between the plunger assemblies 306 and 308 and the inside of the angled outer shell 104 of the protective cover 100. In some examples, the magnets 310 and 312 can move the plunger assemblies 306 and 308 inside the hollow plunger housings 322 and 324 in response to an electronic device being attached to the protective cover 100. For example, an electronic device may include magnets that interact with the magnets 310 and 312 of the protective cover 100 and cause the magnets 310 and 312 to move the plunger assemblies 306 and 308 towards the angled outer shell 104 of the protective cover 100.

In some embodiments, the locking mechanisms 314 and 316 can be engaged or disengaged in response to the plunger assemblies 306 and 308 moving within the hollow plunger housings 322 and 324. For example, the locking mechanisms 314 and 316 may include cantilever bar locks that reside between the bottom of the plunger assemblies 306 and 308 and the fixed base 108 of the protective cover 100. In some examples, the cantilever bar locks 314 and 316 can be disengaged when the plunger assemblies 306 and 308 move and allow the cantilever bar locks 314 and 316 to slide out of locking grooves 324 and 326 in the hollow plunger assemblies 322 and 324. In some embodiments, the locking mechanisms 314 and 316 can also use ball locks in place of cantilever bar locks, among any other suitable type of locking mechanism. The locking mechanisms 314 and 316 are described in greater detail below in relation to FIGS. 4 and 5.

It is to be understood that the block diagram of FIG. 3 is not intended to indicate that the protective cover 100 is to include all of the components shown in FIG. 3. Rather, the protective cover 100 can include fewer or additional components not illustrated in FIG. 3. For example, the protective cover 100 can include any suitable number of magnets, plunger assemblies, and springs. Additionally, the protective cover 100 can be manufactured from any suitable material such as thermoplastic or thermosetting polymers, among others.

Figure 4:
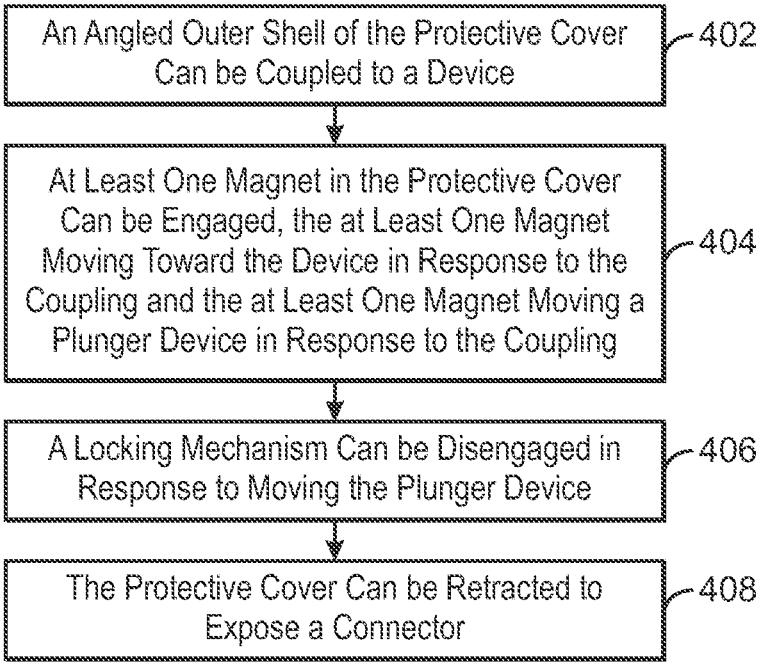
FIG. 4 is a process flow diagram of an example method for engaging a protective cover.

FIG. 4 is a process flow diagram of an example method for disengaging a protective cover. The phrase disengaging a protective cover, as used herein, refers to techniques to retract a protective cover to expose a connector. In some embodiments, the method 400 can be implemented with the protective cover 100 of FIG. 1.

At block 402, an angled outer shell of the protective cover 100 can be coupled to a device. In some embodiments, coupling the protective cover 100 to any suitable electronic device can facilitate the transmission of data through a connector enveloped by the protective cover 100. For example, the protective cover 100 may envelop or cover a connector that protrudes from a surface of a computing device. In some embodiments, coupling the protective cover 100 to an electronic device can expose the connector and allow the computing device with the protruding connector to be docked with any suitable electronic device or cable.

At block 404, at least one magnet in the protective cover 100 can be engaged, the at least one magnet moving toward a device in response to the coupling and the at least one magnet moving a plunger assembly in response to the coupling. In some embodiments, the device being coupled to the protective cover 100 can include a second set of magnets that interact with the at least one magnet in the protective cover 100. The interaction of the set of magnets in the device and the at least one magnet in the protective cover 100 can result in the plunger assembly moving toward the angled outer shell of the protective cover 100.

At block 406, a locking mechanism can be disengaged in response to moving the plunger assembly. In some embodiments, the locking mechanism can be unlocked or disengaged when the plunger assembly moves in a hollow plunger housing to expose a locking groove that accepts a cantilever bar lock or a ball lock, among others. When the plunger assembly moves to a location or position that is not adjacent to the locking groove, the cantilever bar lock or ball lock is able to be removed from the locking groove.

At block 408, the protective cover can be retracted to expose a connector. In some embodiments, the protective cover 100 is retracted in response to a force applied to the protective cover 100 once the locking mechanism is disengaged. For example, when a magnet from the protective cover 100 interacts with a magnet from a device being coupled to the protective cover 100, the magnet in the protective cover 100 can move the plunger assembly and allow the locking mechanism to move out of the locking groove in the hollow plunger housing. A force applied to the protective cover can then compress springs in the protective cover 100 to retract the protective cover and expose a connector.

The process flow diagram of FIG. 4 is not intended to indicate that the operations of the method 400 are to be executed in any particular order, or that all of the operations of the method 400 are to be included in every case. Additionally, the method 400 can include any suitable number of additional operations. In some embodiments, the locking mechanism is disengaged in response to a device with at least two magnets being coupled to the two magnets of the protective cover.

Figure 5:
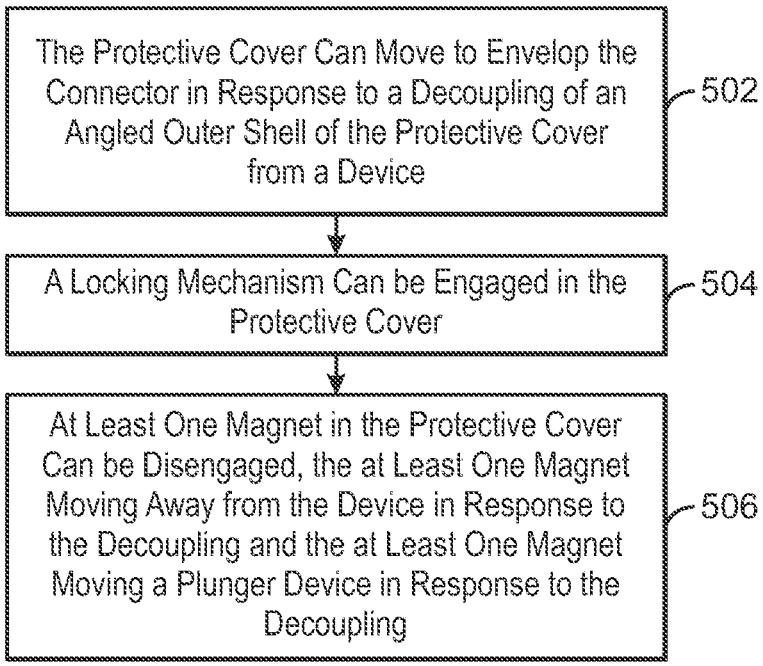
FIG. 5 is a process flow diagram of an example method for disengaging a protective cover.

FIG. 5 is a process flow diagram of an example method for engaging a protective cover. The phrase engaging a protective cover, as used herein, refers to techniques to move a protective cover to envelop or cover a connector. In some embodiments, the method 500 can be implemented with the protective cover 100 of FIG. 1.

At block 502, the protective cover 100 can move to envelop the connector in response to a decoupling of an angled outer shell of the protective cover 100 from a device. In some embodiments, when a device is removed from a connector, the protective cover 100 can move to envelop and protect the connector. For example, removing the device from the connector can cause springs in the protective cover 100 to decompress, which can move the protective cover 100 to protect the connector. In some embodiments, at least one magnet in the protective cover 100 can remain in contact with at least one magnet from the device being decoupled as the protective cover 100 moves to protect and envelop the connector.

At block 504, a locking mechanism can be engaged in the protective cover 100. In some embodiments, as discussed above, the locking mechanism can include a ball lock or a cantilever bar lock that engages a locking groove in the hollow plunger housing of the protective cover 100. For example, as the angled outer shell of the protective cover 100 moves away from the fixed base of the protective cover 100, a ball lock or cantilever bar lock, among others, can slide within the hollow plunger housing until the ball lock or the cantilever bar lock contacts and expands into the locking groove in the hollow plunger housing. In some embodiments, the locking mechanism can prevent objects from moving the protective cover 100 to expose the connector. For example, the locking mechanism may prevent the protective cover 100 from being disengaged or unlocked until a device with at least one magnet engages at least one magnet in the protective cover. An engaged locking mechanism can also be referred to as being in a locked position.

At block 506, at least one magnet in the protective cover 100 can be disengaged, the at least one magnet moving away from the device in response to the decoupling and the at least one magnet moving a plunger assembly in response to the decoupling. In some embodiments, as illustrated above in relation to FIG. 3, each plunger assembly in the protective cover 100 can be attached to at least one magnet. In some examples, as the at least one magnet attached to the plunger assembly is disengaged from at least one magnet in the device, the plunger assembly can move toward the fixed base of the protective cover 100 from the angled outer shell. In some embodiments, the plunger assembly can move so that the plunger assembly is adjacent to the locking groove in the hollow plunger housing of the protective cover, which can prevent the locking mechanism from becoming disengaged.

The process flow diagram of FIG. 5 is not intended to indicate that the operations of the method 500 are to be executed in any particular order, or that all of the operations of the method 500 are to be included in every case. Additionally, the method 500 can include any suitable number of additional operations.

Figure 6:
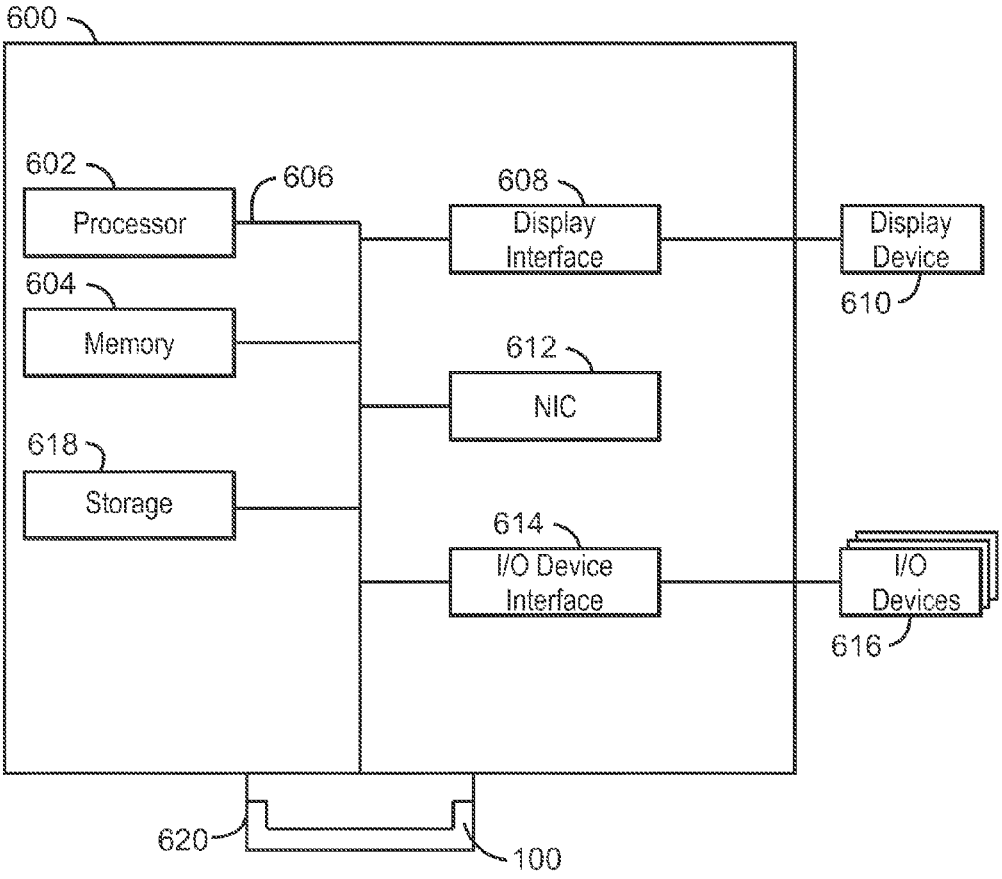
FIG. 6 is a bock diagram of an example computing device that includes a protective cover.

FIG. 6 is a block diagram of an example of a computing device that includes a protective cover. The computing device 600 may be, for example, a mobile phone, laptop computer, desktop computer, or tablet computer, among others. The computing device 600 may include a processor 602 that is adapted to execute stored instructions, as well as a memory device 604 that stores instructions that are executable by the processor 602. The processor 602 can be a single core processor, a multi-core processor, a computing cluster, a system on a chip, or any number of other configurations. The memory device 604 can include random access memory, read only memory, flash memory, or any other suitable memory systems.

The processor 602 may also be linked through the system interconnect 606 (e.g., PCI®, PCI-Express®, HyperTransport®, NuBus, etc.) to a display interface 608 adapted to connect the computing device 600 to a display device 610. The display device 610 may include a display screen that is a built-in component of the computing device 600. The display device 610 may also include a computer monitor, television, or projector, among others, that is externally connected to the computing device 600. In addition, a network interface controller (also referred to herein as a NIC) 612 may be adapted to connect the computing device 600 through the system interconnect 606 to a network (not depicted). The network (not depicted) may be a cellular network, a radio network, a wide area network (WAN), a local area network (LAN), or the Internet, among others.

The processor 602 may be connected through a system interconnect 606 to an input/output (I/O) device interface 614 adapted to connect the computing device 600 to one or more I/O devices 616. The I/O devices 616 may include, for example, a keyboard and a pointing device, wherein the pointing device may include a touchpad or a touchscreen, among others. The I/O devices 616 may be built-in components of the computing device 600, or may be devices that are externally connected to the computing device 600.

In some embodiments, the processor 602 may also be linked through the system interconnect 606 to a storage device 618 that can include a hard drive, an optical drive, a USB flash drive, an array of drives, or any combinations thereof. Additionally, the processor 602 may be linked through the system interconnect 606 to a connector 620. As discussed above, a connector 620 may include a universal serial bus connector, among others. In some examples, the connector 620 can transmit data to or from the processor 602 to any suitable electronic device or cable, among others. In some embodiments, the connector 620 includes a protective cover 100 that can prevent the connector 620 from being damaged. The protective cover 100 can include any suitable number of components, as illustrated above in relation to FIGS. 1-5. For example, the protective cover 100 can include any suitable number of flanges, springs, plunger assemblies, magnets, locking grooves, and locking mechanisms, among others.

It is to be understood that the block diagram of FIG. 6 is not intended to indicate that the computing device 600 is to include all of the components shown in FIG. 6. Rather, the computing device 600 can include fewer or additional components not illustrated in FIG. 6 (e.g., additional connectors, additional protective covers, embedded controllers, additional modules, additional network interfaces, etc.). In some embodiments, the functionalities of the processor 602 can be implemented with logic, wherein the logic, as referred to herein, can include any suitable hardware (e.g., a processor, among others), software (e.g., an application, among others), firmware, or any suitable combination of hardware, software, and firmware.

Example 1

A protective cover is described herein. In some examples, the protective cover includes an angled outer shell to envelop a connector, and a locking mechanism to prevent the angled outer shell from retracting to expose the connector. The protective cover can also include a plunger assembly coupled to a magnet, the magnet to disengage the locking mechanism to expose the connector and a set of springs to return the angled outer shell to a locked position.

In some examples, the locking mechanism comprises a ball lock. Alternatively, or in addition, the locking mechanism can include a cantilever bar lock. Alternatively, or in addition, the magnet can move the plunger in response to the angled outer shell being coupled to a device comprising a second magnet. Alternatively, or in addition, the protective cover can include a second plunger assembly coupled to a second magnet. Alternatively, or in addition, the locking mechanism can be disengaged in response to a device with at least two magnets being coupled to the two magnets of the protective cover. Alternatively, or in addition, the angled outer shell can include at least two sides that are less than perpendicular in relation to a fixed base of the protective cover. Alternatively, or in addition, the plunger assembly can include a locking groove to be filled with a ball lock. Alternatively, or in addition, the plunger assembly comprises a locking groove to be filled with a cantilever bar lock.

Example 2

A method for engaging a protective cover for a connector is described herein. In some examples, the method can include moving the protective cover to envelop the connector in response to a decoupling of an angled outer shell of the protective cover from a device and engaging a locking mechanism in the protective cover. The method can also include disengaging at least one magnet in the protective cover, the at least one magnet moving away from the device in response to the decoupling and the at least one magnet moving a plunger assembly in response to the decoupling.

In some examples, the method can also include engaging a ball lock in a locking groove in the plunger assembly. Alternatively, or in addition, the method can also include engaging a cantilever bar lock in a locking groove in the plunger assembly. In some examples, the locking mechanism is engaged in response to a device with at least two magnets being decoupled from at least two magnets of the protective cover. Additionally, in some examples, the method includes decompressing at least one spring in response to decoupling the angled outer shell from the device.

Example 3

A method for disengaging a protective cover is described herein. In some example, the method includes engaging at least one magnet in the protective cover, the at least one magnet moving toward the device in response to a coupling of an angled outer shell of the protective cover to a device, and the at least one magnet moving a plunger assembly in response to the coupling. The method can also include disengaging a locking mechanism in response to moving the plunger assembly, and retracting the protective cover to expose a connector.

In some embodiments, disengaging the locking mechanism comprises disengaging a ball lock from a locking groove in the plunger assembly. Alternatively, or in addition, disengaging the locking mechanism comprises disengaging a cantilever bar lock from a locking groove in the plunger assembly. Alternatively, or in addition, the angled outer shell comprises at least two sides that are less than perpendicular in relation to a fixed base of the protective cover. Alternatively, or in addition, the locking mechanism is disengaged in response to a device with at least two magnets being coupled to at least two magnets of the protective cover. Alternatively, or in addition, the method can include compressing at least one spring in response to coupling the angled outer shell of the protective cover to the device.

Example 4

A system comprising logic to transmit data via a connector, the connector comprising a protective cover is described herein. In some examples, the protective cover includes a plunger assembly coupled to a magnet, the magnet to engage a locking mechanism to expose the connector in response to decoupling the protective cover from an electronic device, and an angled outer shell to envelop the connector. The protective cover can also include a locking mechanism to prevent the angled outer shell from retracting to expose the connector.

In some embodiments, the protective cover comprises a set of springs that return the angled outer shell to a locked position in response to the decoupling of the electronic device from the protective cover. Alternatively, or in addition, the logic can be a system on a chip. Alternatively, or in addition, the locking mechanism can include a ball lock or a cantilever bar lock.

Example 5

A protective cover is described herein. In some examples, the protective cover comprises means for coupling an angled outer shell of the protective cover to a device and means for engaging at least one magnet in the protective cover, the at least one magnet moving toward the device in response to the coupling and the at least one magnet moving a plunger assembly in response to the coupling. The protective cover can also include means for disengaging a locking mechanism in response to moving the plunger assembly, and means for retracting the protective cover to expose a connector.

In some embodiments, means for disengaging the locking mechanism comprises disengaging a ball lock from a locking groove in the plunger assembly. Alternatively, or in addition, means for disengaging the locking mechanism comprises disengaging a cantilever bar lock from a locking groove in the plunger assembly. Alternatively, or in addition, the angled outer shell comprises at least two sides that are less than perpendicular in relation to a fixed base of the protective cover. Alternatively, or in addition, the locking mechanism is disengaged in response to a device with at least two magnets being coupled to at least two magnets of the protective cover. Alternatively, or in addition, the protective cover includes means for compressing at least one spring in response to coupling the angled outer shell of the protective cover to the device.

Although an example embodiment of the disclosed subject matter is described with reference to block and flow diagrams in FIGS. 1-6, persons of ordinary skill in the art will readily appreciate that many other methods of implementing the disclosed subject matter may alternatively be used. For example, the order of execution of the blocks in flow diagrams may be changed, and/or some of the blocks in block/flow diagrams described may be changed, eliminated, or combined.

In the preceding description, various aspects of the disclosed subject matter have been described. For purposes of explanation, specific numbers, systems and configurations were set forth in order to provide a thorough understanding of the subject matter. However, it is apparent to one skilled in the art having the benefit of this disclosure that the subject matter may be practiced without the specific details. In other instances, well-known features, components, or modules were omitted, simplified, combined, or split in order not to obscure the disclosed subject matter.

Various embodiments of the disclosed subject matter may be implemented in hardware, firmware, software, or combination thereof, and may be described by reference to or in conjunction with program code, such as instructions, functions, procedures, data structures, logic, application programs, design representations or formats for simulation, emulation, and fabrication of a design, which when accessed by a machine results in the machine performing tasks, defining abstract data types or low-level hardware contexts, or producing a result.

Program code may represent hardware using a hardware description language or another functional description language which essentially provides a model of how designed hardware is expected to perform. Program code may be assembly or machine language or hardware-definition languages, or data that may be compiled and/or interpreted.

Furthermore, it is common in the art to speak of software, in one form or another as taking an action or causing a result. Such expressions are merely a shorthand way of stating execution of program code by a processing system which causes a processor to perform an action or produce a result.

Program code may be stored in, for example, volatile and/or non-volatile memory, such as storage devices and/or an associated machine readable or machine accessible medium including solid-state memory, hard-drives, floppy-disks, optical storage, tapes, flash memory, memory sticks, digital video disks, digital versatile discs (DVDs), etc., as well as more exotic mediums such as machine-accessible biological state preserving storage. A machine readable medium may include any tangible mechanism for storing, transmitting, or receiving information in a form readable by a machine, such as antennas, optical fibers, communication interfaces, etc. Program code may be transmitted in the form of packets, serial data, parallel data, etc., and may be used in a compressed or encrypted format.

Program code may be implemented in programs executing on programmable machines such as mobile or stationary computers, personal digital assistants, set top boxes, cellular telephones and pagers, and other electronic devices, each including a processor, volatile and/or non-volatile memory readable by the processor, at least one input device and/or one or more output devices. Program code may be applied to the data entered using the input device to perform the described embodiments and to generate output information. The output information may be applied to one or more output devices. One of ordinary skill in the art may appreciate that embodiments of the disclosed subject matter can be practiced with various computer system configurations, including multiprocessor or multiple-core processor systems, minicomputers, mainframe computers, as well as pervasive or miniature computers or processors that may be embedded into virtually any device. Embodiments of the disclosed subject matter can also be practiced in distributed computing environments where tasks may be performed by remote processing devices that are linked through a communications network.

Although operations may be described as a sequential process, some of the operations may in fact be performed in parallel, concurrently, and/or in a distributed environment, and with program code stored locally and/or remotely for access by single or multi-processor machines. In addition, in some embodiments the order of operations may be rearranged without departing from the spirit of the disclosed subject matter. Program code may be used by or in conjunction with embedded controllers.

While the disclosed subject matter has been described with reference to illustrative embodiments, this description is not intended to be construed in a limiting sense. Various modifications of the illustrative embodiments, as well as other embodiments of the subject matter, which are apparent to persons skilled in the art to which the disclosed subject matter pertains are deemed to lie within the scope of the disclosed subject matter.

What is claimed is:

1. A protective cover comprising:

an angled outer shell to envelop a connector;

a locking mechanism to prevent the angled outer shell from retracting to expose the connector, the locking mechanism comprising a ball lock or a cantilever bar lock;

a plunger assembly coupled to a magnet, the magnet to disengage the locking mechanism to expose the connector; and a set of springs to return the angled outer shell to a locked position.

2. The protective cover of claim 1, wherein the magnet is to move the plunger in response to the angled outer shell being coupled to a device comprising a second magnet.

3. The protective cover of claim 1, wherein the protective cover comprises a second plunger assembly coupled to a second magnet.

4. The protective cover of claim 3, wherein the locking mechanism is disengaged in response to a device with at least two magnets being coupled to the two magnets of the protective cover.

5. The protective cover of claim 1, wherein the angled outer shell comprises at least two sides that are less than perpendicular in relation to a fixed base of the protective cover.

6. The protective cover of claim 1, wherein the plunger assembly comprises a locking groove to be filled with the ball lock.

7. The protective cover of claim 1, wherein the plunger assembly comprises a locking groove to be filled with the cantilever bar lock.

8. A method for disengaging a protective cover comprising:

engaging at least one magnet in the protective cover, the at least one magnet moving toward the device in response to a coupling of an angled outer shell of the protective cover to a device, and the at least one magnet moving a plunger assembly in response to the coupling;

disengaging a locking mechanism from a locking groove in the plunger assembly in response to moving the plunger assembly, the locking mechanism comprising a ball lock or a cantilever bar lock; and retracting the protective cover to expose a connector.

9. The method of claim 8, wherein the angled outer shell comprises at least two sides that are less than perpendicular in relation to a fixed base of the protective cover.

10. The method of claim 8, wherein the locking mechanism is disengaged in response to a device with at least two magnets being coupled to at least two magnets of the protective cover.

11. The method of claim 8, comprising compressing at least one spring in response to coupling the angled outer shell of the protective cover to the device.

12. A system comprising:

logic to transmit data via a connector, the connector comprising a protective cover comprising:

a plunger assembly coupled to a magnet, the magnet to engage a locking mechanism to expose the connector in response to decoupling the protective cover from an electronic device;

an angled outer shell to envelop the connector; and a locking mechanism to prevent the angled outer shell from retracting to expose the connector, the locking mechanism comprising a ball lock or a cantilever bar lock.

13. The system of claim 12, wherein the protective cover comprises a set of springs that return the angled outer shell to a locked position in response to the decoupling of the electronic device from the protective cover.

14. The system of claim 12, wherein the logic is a system on a chip.

15. The system of claim 12, wherein the plunger assembly comprises a locking groove to be filled with a ball lock or a cantilever bar lock.

* * * * *